United States Patent [19]

Auty et al.

[11] Patent Number: 4,936,398

[45] Date of Patent: Jun. 26, 1990

[54] ROTARY DRILLING DEVICE

[75] Inventors: David H. Auty; Peter G. Wheeldon, both of Guildford, England

[73] Assignee: Cledisc International B.V., Amsterdam, Netherlands

[21] Appl. No.: 378,560

[22] Filed: Jul. 7, 1989

[51] Int. Cl.[5] ..... E21B 10/08

[52] U.S. Cl. ..... 175/336; 175/343; 175/353; 175/365; 175/376

[58] Field of Search ..... 175/336, 343, 356, 373, 175/376, 408, 331

[56] References Cited

U.S. PATENT DOCUMENTS

| | | | |
|---|---|---|---|
| 1,852,843 | 4/1932 | Greve | 175/376 X |
| 1,879,127 | 9/1932 | Schlumpf | 175/376 X |
| 3,424,258 | 1/1969 | Nakayama | 175/333 |
| 4,285,409 | 8/1981 | Allen | 175/336 |
| 4,444,281 | 4/1984 | Schumacher, Jr. et al. | 175/336 |
| 4,549,614 | 10/1985 | Kaalstad et al. | 175/339 |
| 4,790,397 | 12/1988 | Kaalstad et al. | 175/376 X |
| 4,832,143 | 5/1989 | Kaalstad et al. | 175/376 X |

*Primary Examiner*—Hoang C. Dang

*Attorney, Agent, or Firm*—Hoffmann & Baron

[57] ABSTRACT

A drill bit for earth boring purposes includes a drill bit body which is rotatable about a drilling axis, a single cutting member mounted rotatably on the body and a counter-reaction member also mounted on the body. The counter-reaction member extends partially downwardly from the body and includes first and second outwardly exposed surfaces. The first surface has a greater surface area than the second surface and is at least partially formed with a circumferentially disposed curvature and a longitudinally disposed curvature with respect to the drilling axis so that it can closely conform to and contact the curvature of the bottom of the hole formed by the drill bit. The first surface of the counter-reaction member acts as a friction pad to counteract the torque effects of rotating the drill bit about the drilling axis and the cutting member engaging in the ground. The second surface is situated substantially circumferentially adjacent to the first surface and is inwardly angularly disposed with respect to the first surface and forms an obtuse angle with the first surface. The second surface has a plurality of teeth mounted on it for smoothing the bottom of the hole formed by the drill bit by removing ridges formed in the bottom of the hole by the teeth of the cutting member as the drill bit rotates.

12 Claims, 6 Drawing Sheets

ROTARY DRILLING DEVICE

BACKGROUND OF THE INVENTION

1. Field of the Invention

The present invention relates generally to earth boring equipment and, more particularly, relates to a rotary device or drill bit having a main drill bit body and a counter-reaction member mounted on the side of the drill bit body.

2. Description of the Prior Art

U.S. Pat. Nos. 4,549,614; 4,790,397; and 4,832,143, each of which issued to Oscar Kaalstad and neil G. Reid, describe drill bits having counter-reaction members mounted on a side of the drill bit bodies. The counter-reaction members are provided to help counteract the radial forces imposed by the ground on the drill bit, which helps prevent the drill bit from wandering from the drilling axis.

OBJECTS AND SUMMARY OF THE INVENTION

It is an object of the present invention to provide a rotary drill bit which is adapted to react the torque applied to the drill bit from the rig to which it is coupled.

It is another object of the present invention to provide a rotary drill bit for earth boring applications which is adapted to react the download force applied on the bit by the weight of the drill string to which it is coupled to ensure proper cutting by the bit.

It is a further object of the present invention to provide an earth boring device which exhibits above standard drilling performance and has an extended bit life.

It is yet another object of the present invention to provide a rotary drill bit which maintains equilibrium during a drilling operation.

It is still a further object of the present invention to provide a rotary drill bit having a counter-reaction member which is an improvement over the drill bits described in the U.S. patents to Oscar Kaalstadt and Neil Reid referred to previously.

In accordance with one form of the present invention, a rotary drill bit for earth boring purposes includes a drill bit body which is rotatable about a drilling axis. The drill bit will form a hole in the ground having a substantially cylindrical wall portion and a generally concave bottom portion extending downwardly from the lowermost portion of the cylindrical wall portion.

A single cutting member is mounted rotatably on the body. The cutting member extends outwardly and downwardly from the body and includes a plurality of teeth.

At least some of the teeth of the cutting member are positionable in a first cutting position during rotation of the cutting member. The first "cutting" position can be defined as the position of the teeth at their maximum radial distance from the drilling axis while they are in contact with the ground. The teeth in the first cutting position will shape the cylindrical wall portion of the hole formed by the drill bit in the ground.

Also, at least some of the teeth of the cutting member are positionable in a second "leading" position during rotation of the cutting member. The second leading position can be defined as the maximum or most advanced circumferential position of the teeth about the drilling axis in the direction of rotation of the drill bit body.

The rotary drill bit of the present invention also includes a counter-reaction member. The counter-reaction member is mounted on the drill bit body and extends at least partially downwardly from the body.

The counter-reaction member has first and second outwardly exposed surfaces. The first surface preferably has a greater surface area than the second surface, and is at least partially formed with a circumferentially disposed curvature and a longitudinally disposed curvature with respect to the drilling axis so that the first surface can closely conform to and contact the curvature of the concave bottom portion of the hole formed by the drill bit. The first surface of the counter-reaction member further has a trailing edge, and a leading edge circumferentially opposite the trailing edge. This first surface of the counter-reaction member acts as a friction pad to counteract the torque effects of rotating the drill bit about the drilling axis and the cutting member engaging the ground.

The second surface of the counter-reaction member is situated circumferentially adjacent to the first surface and, furthermore, is inwardly angularly disposed with respect to the first surface so as to form an obtuse angle with the first surface.

The second surface of the counter-reaction member has a plurality of teeth mounted on it. These teeth project from the second surface to smooth the concave bottom portion of the hole by removing ridges formed in the bottom portion by the teeth of the cutting member as the drill bit rotates.

The counter-reaction member is particularly situated circumferentially on the drill bit body in relation to the cutting member such that the leading edge of the first surface is at most 180°, measured in a direction opposite the rotational direction of the drill bit body, from the second leading position of the cutting member teeth, and such that the trailing edge of the first surface is at most 180°, measured in the rotational direction of the drill bit body, from the first cutting position of the cutting member teeth.

The drill bit, as it rotates, has a tendency to pivot about the effective or mean cutting point on the cutting member. However, with the counter-reaction member shaped and positioned on the drill bit body as described above, the forces acting on the drill bit which tend to make it pivot will be counteracted by the counter-reaction member abutting against the concave bottom of the hole, thus negating the effect of these forces and maintaining the drill bit in equilibrium.

These and other objects, features and advantages of the present invention will be more apparent from the following detailed description of illustrative embodiments thereof, which is to be read in connection with the accompanying drawings.

DETAILED DESCRIPTION OF THE PREFERRED EMBODIMENTS

Figure 1:
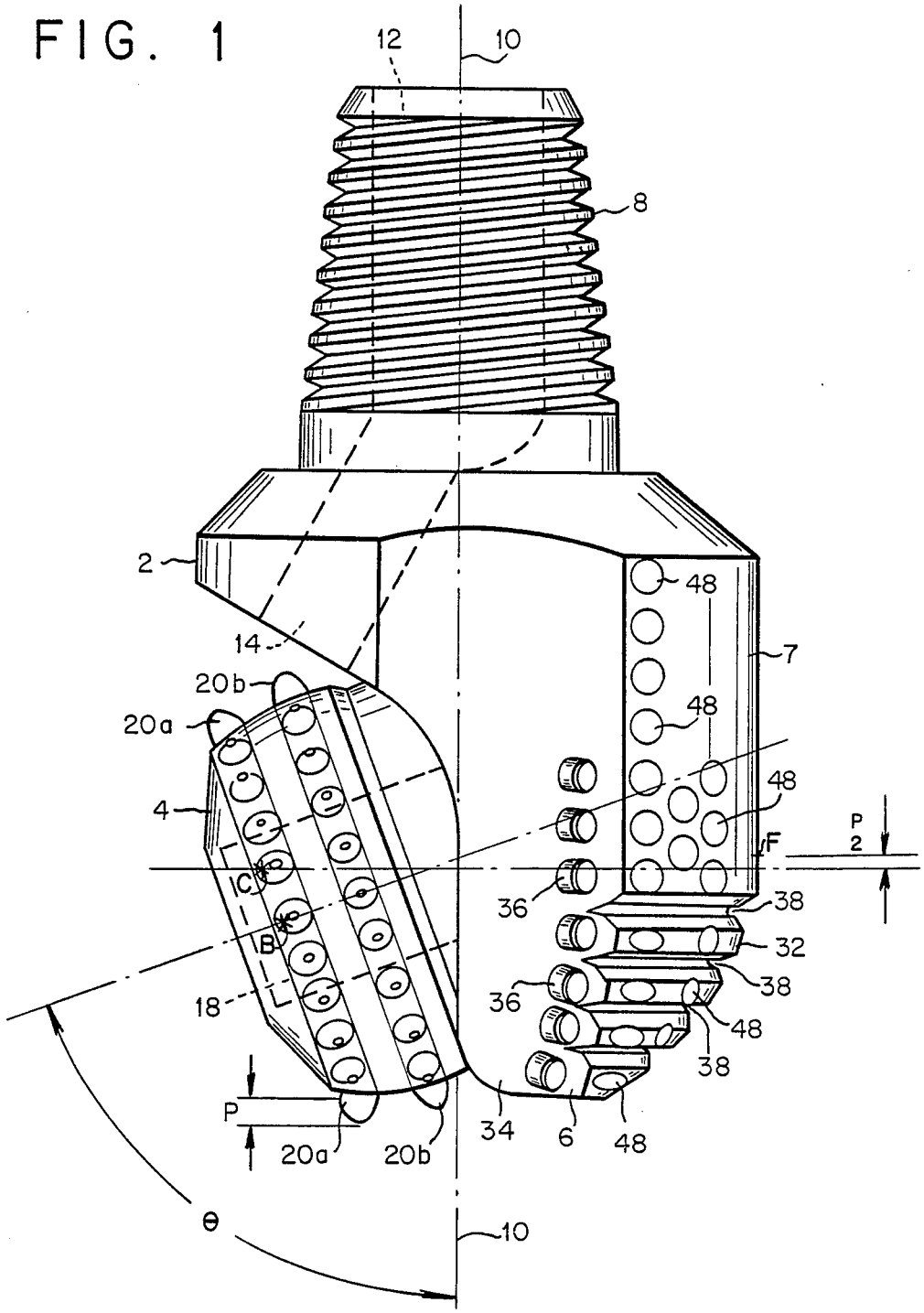
FIG. 1 is a side elevational view of the rotary drill bit formed in accordance with one form of the present invention.
Figure 2:
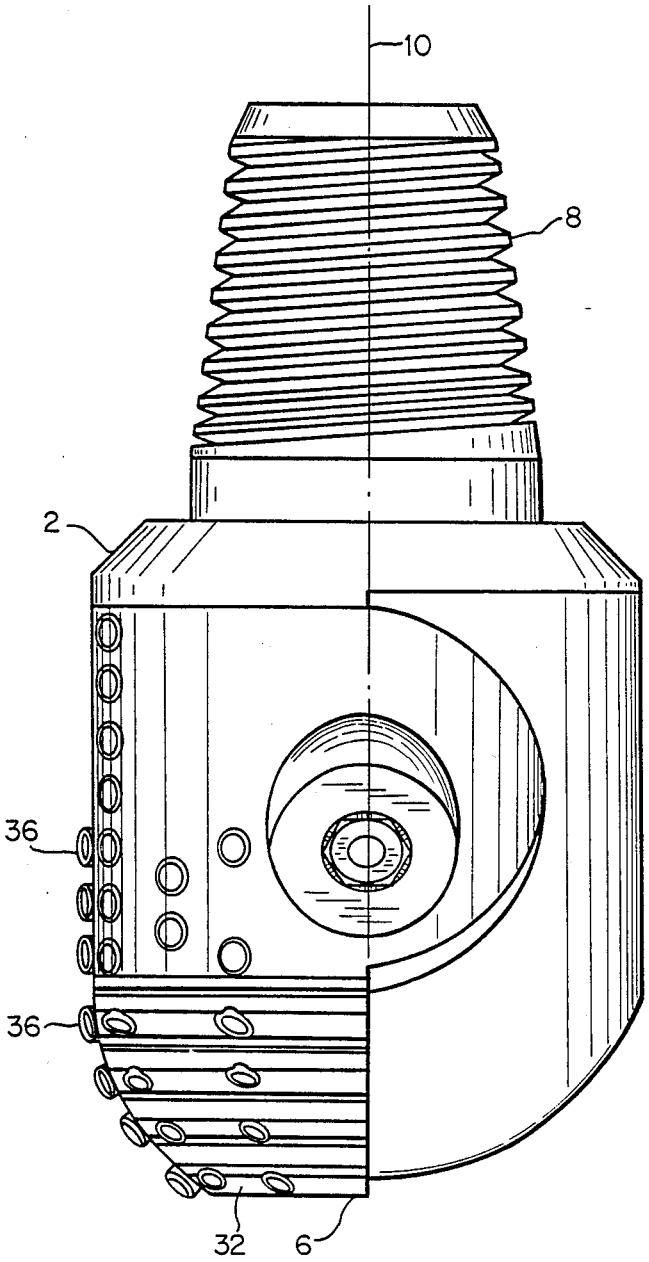
FIG. 2 is a rear elevational view of the drill bit shown in FIG. 1.
Figure 3:
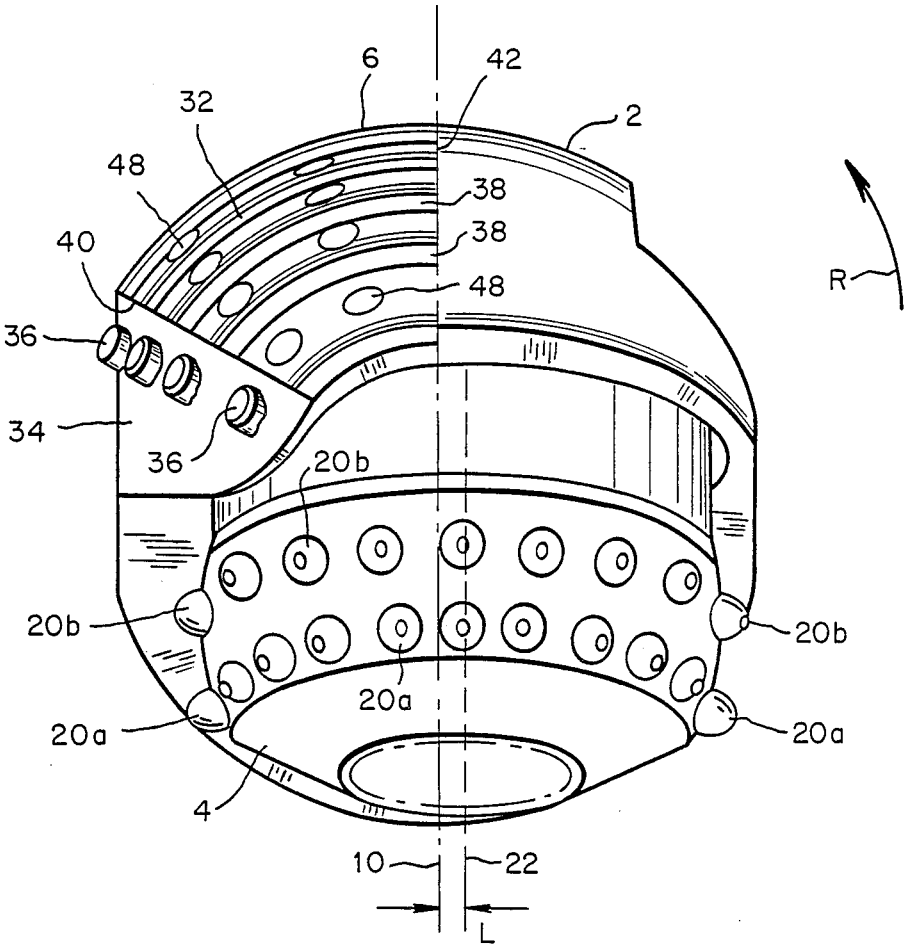
FIG. 3 is a bottom plan view of the drill bit shown in FIG. 1.

Referring initially to FIGS. 1 through 3 of the drawings, a rotary drilling device for earth boring purposes constructed in accordance with the present invention basically includes a drill bit body 2, a rotary cutting disc 4 and a counter-reaction member 6.

The drill bit body 2 includes an upper portion 8 which is formed as a threaded shaft to effect its connection to associated equipment, such as the drill string and drill rig, which equipment drives the drill bit body rotatably about a drilling axis 10. The body 2 may include a conduit 12 which passes through the body for circulating drilling fluid under pressure through the bit. The conduit 12 opens into an orifice 14 situated on the underside of the body between the cutting member or disc 4 and the counter-reaction member 6 to direct drilling fluid to the bottom of the hole, in order to remove debris produced at the cutting face by the action of the disc.

A cylindrical axle or spindle 18 is mounted on the lower portion of the body 2, and has an axis set at an angle $\theta$ to the drilling axis 10 (i.e., the axis of rotation and center line of the body). In conjunction with the design of the disc 4 and the configuration of the cutting teeth situated on the disc, angle $\theta$ is preferably between about 60° and about 80° and is optimally set at 70° and is chosen to ensure that the sweep of the cutting teeth, and the rotation of both the drilling device as a whole and also the disc, covers the entire area of the hole being drilled.

The cutting disc 4 is fitted for angular rotation on the spindle 18 using conventional means, such as plain journal, ball or roller bearings (not shown). The disc includes a plurality of teeth 20 mounted on it and preferably arranged in two parallel planes which are orthogonal to the rotational axis 22 of the disc. More specifically, the teeth are arranged on the disc in an outer row 20*a*, which is closer to the free end of the spindle, and an inner row 20*b*, which is closer to the drill bit body. As the drill bit rotates about the drilling axis 10, the cutting disc 4 is caused to rotate about the spindle 18. The teeth 20*a*, 20*b* of the disc will engage the ground to form a hole having a substantially cylindrical wall portion and a generally concave bottom portion extending downwardly from the lowermost portion of the cylindrical wall portion.

Figure 4:
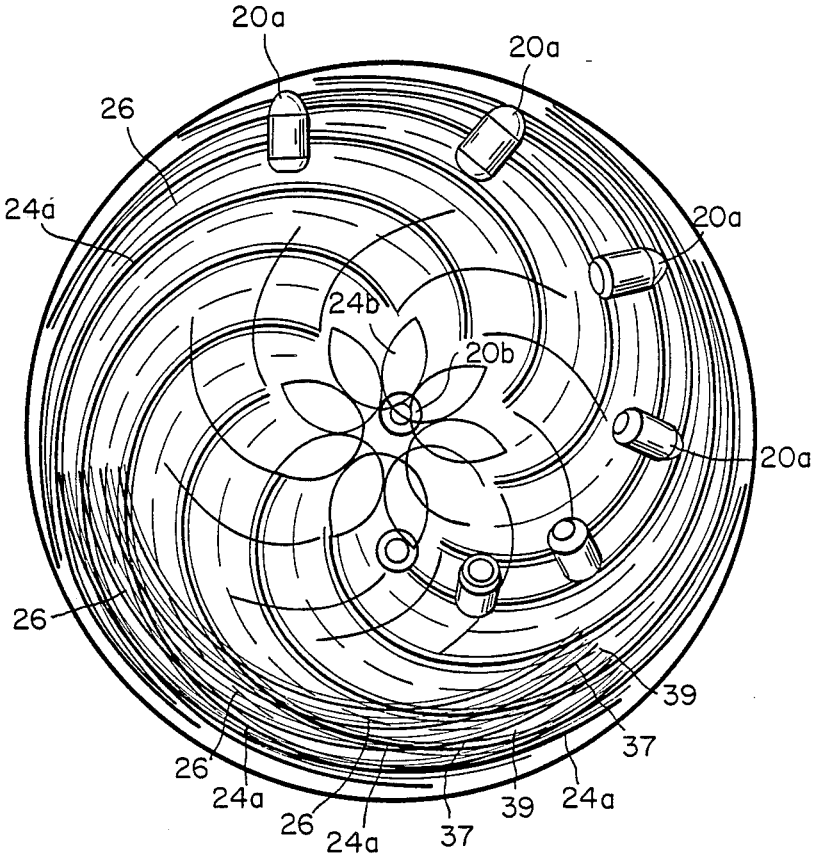
FIG. 4 is an elevational view looking into the bottom portion of a hole cut by the drill bit of the present invention.

The tracks cut by the teeth of the cutting disc 4 and formed in the ground are shown in FIG. 4. As can be seen, the tracks consist of a series of circumferentially downwardly spiralling grooves 24 and ridges 26 in the concave bottom portion of the hole, the outer row of teeth 20*a* forming the outer spiralling grooves 24*a* in the hole bottom, and the inner row of teeth 20*b* forming the inner grooves 24*b* near the center of the bottom of the hole.

Figure 5:
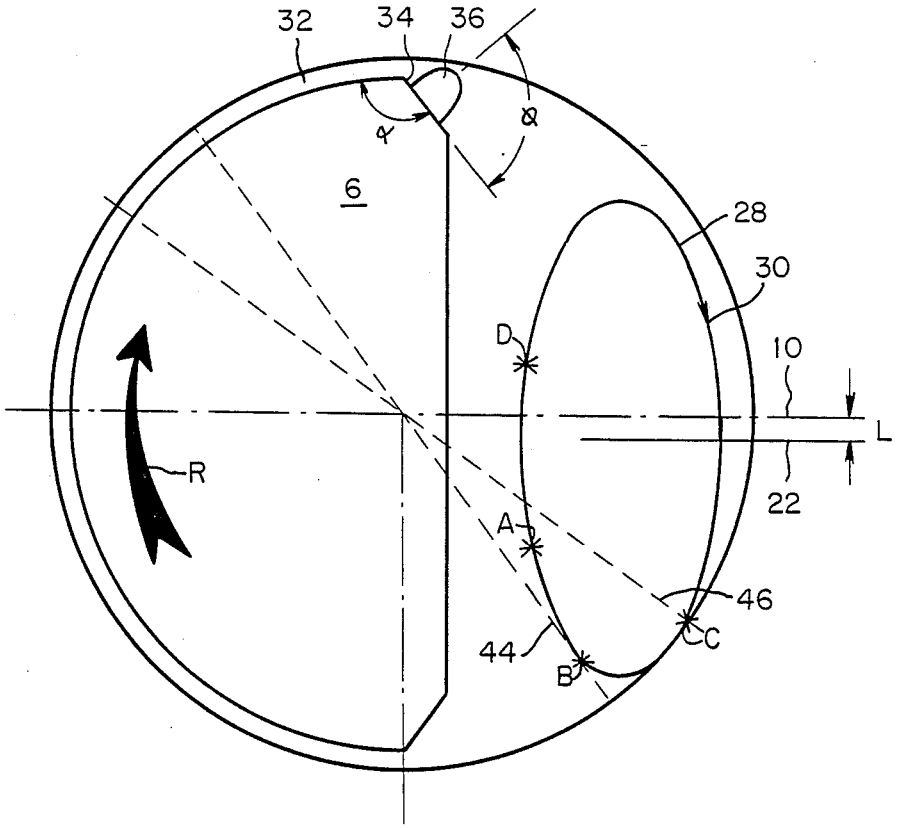
FIG. 5 is a schematic representation of the drill bit, as seen from above, illustrating the preferred position of the counter-reaction member with respect to the cutting member.

As shown in FIGS. 3 and 5, the rotational axis 22 of the cutting disc 4 is displaced from the axis of rotation or drilling axis 10 of the drilling device in the direction of rotation (shown by arrow R) about that axis, so as to provide a "lead" of distance L in the direction of rotation of the drill bit. This displacement ensures that the cutting is performed by the leading teeth on the disc 4 and that clearance exists between the trailing teeth and the hole produced by the drill bit. This prevents the disc from stalling in rotation, which might otherwise be caused by engagement of the trailing teeth with the hole if lead L were not provided. Lead L also facilitates the removal of debris produced at the cutting face in the clearance created behind the disc.

There are two relevant positions which the teeth 20 occupy as the cutting disc rotates. The first position is where the first tooth on the disc 4 contacts the ground as the disc rotates. This position defines the size, or gauge, of the hole being cut. Stated another way, the first cutting position is the position of the teeth 20 at their maximum radial distance from the drilling axis 10 while in contact with the ground. This position is shown schematically in FIG. 5 and is designated by the reference letter C, the solid line 28 being the arc of travel of the outer row of teeth 20*a* on the cutting disc 4 and arrow 30 representing the direction of rotation of the cutting disc.

The second relevant position may be defined as the "leading" position. This is the position of the most leading tooth on the disc 4. Stated another way, the second leading position is the maximum or most advanced circumferential position of the teeth about the drilling axis 10 in the direction of rotation of the drill bit body 2. This position is shown in FIG. 5 and is designated by reference letter B.

Because of the particular angular disposition (i.e., angle $\theta$) of the cutting disc 4, position C will typically be about 15° above position B in an opposite direction to the direction of rotation of the cutting disc, as shown by arrow 30, and position B is the most forward point on the disc (i.e., in the rotational direction of the drill bit).

Position D shown in FIG. 4 is the last position of the teeth 20 before they disengage from the ground. This position is about 135° below position B in the direction of rotation of the cutting disc 4. Thus, a cutting arc of the disc is defined between positions C and D.

The teeth 20 of the cutting disc engage the rock by the combined action of the download forces and torque applied to the bit by the drill rig on a line offset from the center line of the bit, which forces will be described in greater detail. At any one moment the forces on the teeth 20 of the disc caused by the disc 4 cutting into the ground can be combined analytically to define an imaginary effective or mean point of action of the disc. This point is shown schematically in FIG. 5 and designated by reference letter A. The position of this point with respect to the disc 4 will vary from moment to moment due to several factors, including the variations in the properties of the ground into which the hole is being cut. As this effective point of action is necessarily offset from the center line of the bit, the bit has a tendency to rotate about this point on the disc, rather than about its center line. To combat this tendency, a counter-reaction member 6 is provided on the drill bit.

The counter-reaction member 6 is mounted on (that is, as a separate member or integrally formed with) the drill bit body 2. It extends partially downwardly from the drill bit body, as shown in FIGS. 1–3.

The counter-reaction member 6 is preferably situated on the drill bit body 2 and with respect to the cutting disc 4 so that its engagement with the concave bottom portion of the hole will prevent the lowermost tooth of the cutting disc from entering the ground more than a penetration depth P for a full revolution of the drill bit. Depth P is preferably selected to be slightly less than the distance that the teeth 20 protrude from the cutting disc 4.

Stated another way, and as shown in FIG. 1, point C on the cutting disc 4 defines the intersection between the vertical cylindrical wall portion and the concave bottom portion of the hole formed by the drill bit. Point F is a point on the drill bit body 2, in proximity to the counter-reaction member 6, where the counter-reaction member joins a vertical part 7 of the body. Point F also corresponds to the point in the ground, on the side of the drill bit where the counter-reaction member is located, where the vertical cylindrical wall of the hole meets the concave bottom portion. Point F is preferably about ½P above a horizontal line taken through point C on the cutting disc.

The drill bit will perform its cutting more efficiently and its teeth 20 will be less likely to shear off when the teeth are prevented from entering the ground by more than a predetermined distance.

In its preferred form, the counter-reaction member 6 has two distinct outwardly exposed surfaces 32, 34. The first surface 32 has a greater surface area than the second surface 34 and is at least partially formed with a circumferentially disposed curvature and a longitudinally disposed curvature, that is, with respect to the drilling axis 10. With this curvature, the first surface 32 of the counter-reaction member can closely conform to and contact the curvature of the concave bottom portion of the hole formed by the drill bit. This surface of the counter-reaction member acts as a friction pad to counteract the torque effects of rotating the drill bit about the drilling axis and the forces resulting from the cutting member engaging the ground.

The counter-reaction member 6 also includes a distinct second surface 34. The second surface 34 is situated circumferentially (with respect to the drilling axis 10) adjacent to the first surface 32, and is inwardly angularly disposed with respect to the first surface so as to form an obtuse angle $\alpha$ with the first surface 32. Preferably, the angle $\alpha$ between the first and second surfaces is between about 90° and about 175°, and is optimally set at 150°.

A plurality of teeth 36 are mounted on the second surface 34 and project at an angle from the second surface. The teeth 36 are disposed in a row along the second surface 34 longitudinally with respect to the drill bit body 2, and preferably reside in a plane diametrical to the drilling axis 10 or center line of the bit. Thus, the teeth 36 form an obtuse angle $\phi$, for example, of about 135°, with the second surface 34 and lean partially in a direction opposite to the rotational direction of the drill bit so that, as the drill bit turns within the hole, they scrape the ground in the same way as a drag bit. The purpose of these teeth 36 is to remove the ridges 26 formed in the bottom portion of the hole by the teeth of the cutting member 4 as the drill bit rotates. The tracks of teeth 36, which tracks consist of a series of concentric circular grooves 37 and ridges 39, are shown in FIG. 4. The teeth 36 of the second surface 34 of the counter-reaction member are formed from wear-resistant material such as tungsten carbide.

In one preferred form of the invention, the radial distance from the drilling axis 10 or drill bit center line which the teeth 36 mounted on the second surface of the counter-reaction member project is at most equal to the radial distance from the drilling axis 10 of the first surface 32. Thus, the cutting points of the teeth 36 cut at the same radius or at a slightly smaller radius from the bit center line or drilling axis than the radius of the first surface 32 of the counter-reaction member. This minimizes the radial forces on these teeth and thereby reduces tooth wear.

The counter-reaction member 6, and particularly the first surface 32 of the member, may include a number of grooves or recesses 38 which extend circumferentially across the first surface of the counter-reaction member, that is, in the direction of rotation of the drill bit or may be disposed at an angle of, for example, 45°, with respect to the drilling axis across the face of the counter-reaction member. The grooves 38 define channels through which the drilling fluid may flow in order to cool the counter-reaction member 6, as the counter-reaction member will heat up due to the first surface 32 acting as a friction pad and abutting against the concave bottom portion of the hole, and also to flush away debris produced at the cutting face.

Figure 6:
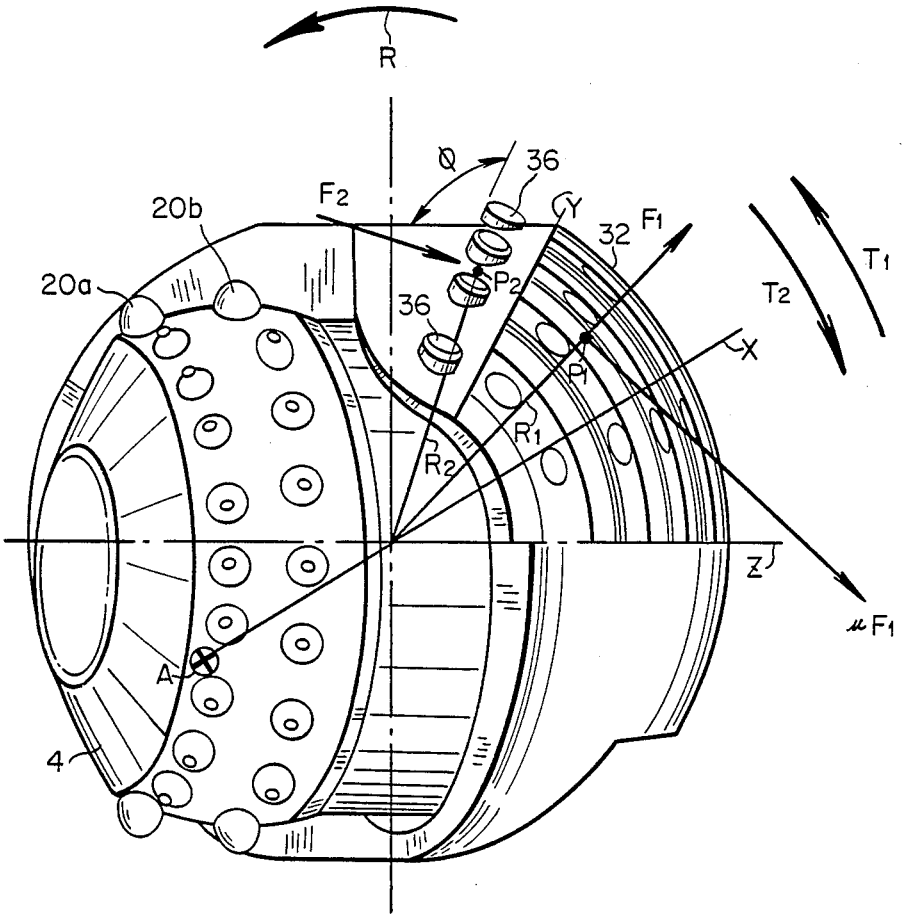
FIG. 6 is the same view of the drill bit as shown in FIG. 3, but further illustrating the forces imposed on the drill bit during a drilling operation and the counter-acting forces provided by the counter-reaction member.

In order to effectively counteract the forces imposed on the drill bit during a drilling operation, the counter-reaction member 6 must be particularly situated on the drill bit body 2 in relation to the cutting member 4. The forces imposed on the drill bit, and the balancing forces of the drill bit which retain the bit in equilibrium, will now be explained with reference to FIG. 6 of the drawings, which is a view of the underside of the drill bit.

Because the cutting face of the disc 4 is eccentric to the center line of the drill bit and stem (i.e., the drilling axis 10), the drill bit will try to pivot about a perpendicular axis through point A which, as described previously, is the momentary effective net point of action of the cutting forces on the disc 4, due to the torque applied by the drilling rig to the drill stem to which the drill bit is connected and due to the forces of the cutting disc engaging the ground. This torque is of value $T_1$ in the direction of bit rotation (see FIG. 6).

If the bit were allowed to pivot due to this torque, its rotation would no longer be concentric with respect to the hole. The drill bit would wander in the hole and the geometry of the hole would be lost at the cutting face of the disc. Poor performance would result. It is the function of the counter-reaction member 6, and in particular the first surface 32 of the member, to prevent any pivot movement about point A by engaging the surface of the ground at the concave bottom portion of the hole and, as described previously, the exposed first surface of the counter-reaction member is so shaped to do this.

When the torque in the drill stem causes the drill bit to try to pivot about point A, the first surface 32 of the counter-reaction member, and in particular that portion of the first surface residing in sector XY (where reference letter X resides in a plane extending through the drilling axis or center line of the drill bit and point A, and reference letter Y defines the leading edge 40 of the first surface 32 of the counter-reaction member, which edge 40 is disposed between the first surface and the second surface 34), is forced against the bottom portion of the hole and, in doing so, radial forces are generated. The resultant $F_1$ of these radial forces, in combination with any other forces resulting from download on the bit or radial reactions from the cutting disc, will act at a point $P_1$ disposed on the first surface 32 of the counter-reaction member and at the center of sector XY. As a result of this, tangential forces will arise due to the friction of the counter-reaction member 6 on the concave bottom portion of the hole, the resultant of which will be $\mu F_1$, where $\mu$ is the coefficient of friction between the counter-reaction member 6 and the ground.

Similar tangential forces will arise from the teeth 36 on the second surface of the counter-reaction member engaging the ground, and more specifically, by planing away the ridges 26 left between the spiral grooves 24 cut by the teeth 20 on the disc. These tangential forces $F_2$ act at point $P_2$, which is a point disposed on the second surface 34 and residing in the plane in which the teeth 36 of the second surface reside.

The combination of $\mu F_1$ and $F_2$ multiplied by their respective distances (i.e., lever arms $R_1$ and $R_2$) from the center line of the drill bit, that is, the drilling axis 10, constitutes a resistive torque $T_2$ to balance the bit in equilibrium and to maintain concentric stability of the bit during a drilling operation such that:

$$\mu F_1 R_1 + F_2 R_2 = T_2 \text{ which balances } T_1.$$

Because pivot point A, which is the effective cutting point on the disc 4, that is, the point at which the resultant of all forces around the cutting disc acts, effectively moves along the cutting arc 28 defined between points C and D (see FIG. 5) depending on the type of rock encountered during the drilling operation, the circumferential width of the counter-reaction member 6, and in particularly the first surface 32 of the member, must be sufficiently large to be able to contact the concave bottom portion of the hole whenever point A of the cutting disc shifts in position. Accordingly, the counter-reaction member 6 should be large enough to include the sector of the first surface 32 of the counter-reaction member defined between references letters X, Z, where Z resides on the trailing edge 42 of the first surface 32 of the counter-reaction member, which is circumferentially opposite the leading edge 40. This will ensure that the counter-reaction member will always be maintained in contact with the ground no matter what hardness of rock is encountered.

Again referring to FIG. 5 of the drawings, the preferred position of the counter-reaction member 6 in relation to the cutting disc 4 will now be described.

There is a counter-rotation limit to the position of the leading edge 40 of the counter-reaction member 6 caused by the need for the member to be always in contact with the ground. In the limiting condition, the effective cutting position of the cutting disc 4 is at the most leading point of the disc, that is, the second leading position described previously and designated by reference letter B in FIG. 5. If a diameter 44 is struck from this position through the center line of the bit, the leading edge 40 of the friction area, or first surface 32, of the counter-reaction member must be on the clockwise side of this diameter 44 when rotation is viewed in the clockwise direction. Stated another way, the leading edge 40 of the first surface of the counter-reaction member is at most 180° in a direction opposite the rotational direction R of the drill bit body from the second leading position of the cutting member teeth 20. If the counter-reaction member trails this diameter 44, the counter-reaction member 6 will disengage from the ground when the effective cutting point on the disc is at this extreme position (i.e., position B). The drill bit will rotate about the instantaneous effective point of action of the cutting disc, i.e., point A, until some other part of the drill bit contacts the concave bottom portion of the hole and provides the required balancing reactions. The bit will then not be drilling to design and may drill the wrong size hole, have poor rate of penetration and wear quickly. A counter-reaction member 6 to the clockwise side of this limiting diameter 44 will always be in contact with the ground.

There is also a preferred limit to the position of the trailing edge 42 of the friction portion, or first surface 32, of the counter-reaction member. During drilling, the first tooth on the disc 4 to contact the ground is at position C, the first cutting position described previously, and this position defines the size, or gauge, of the hole being cut. If a diameter 46 is struck from position C through the center line of the bit, the trailing edge 42 of the friction pad, or first surface 32, of the counter-reaction member should trail behind this diameter 46, that is, be positioned counter-clockwise from this line when the bit is viewed as rotating in the clockwise direction. Stated another way, the trailing edge 42 of the first surface 32 is at most 180° in the rotational direction of the drill bit body from the first cutting position of the cutting member teeth 20. If the counter-reaction member is positioned in this manner, the point C on the cutting disc 4 and the portion of the counter-reaction member 6 across from point C define the diameter of the hole and ensure that it maintains gauge.

In its preferred form, the drill bit of the present invention is formed with a steel body having tungsten carbide inserts or studs 48 substantially flush mounted over a portion of the first surface 32 of the counter-reaction member 6. The counter-reaction member may also be formed from hard or wear-resistant materials or welded or sprayed overlays, or surface hardened materials.

It can be seen from the above description that the drill bit of the present invention is structured to counteract the forces imposed on the drill bit during a drilling operation and to thus maintain the equilibrium of the drill bit and the gauge of the hole being drilled. Because equilibrium is maintained, the drill bit will wear less and have a prolonged effective life.

Although illustrative embodiments of the present invention have been described herein with reference to the accompanying drawings, it is to be understood that the invention is not limited to those precise embodiments, and that various other changes and other modifications may be effected therein by one skilled in the art without departing from the scope or spirit of the invention.

What is claimed is:

1. A rotary drill bit for earth boring purposes, which comprises:

a drill bit body rotatable about a drilling axis in a direction of rotation to form a hole in the ground;

a single cutting member mounted rotatably on the body and extending outwardly and downwardly therefrom, the cutting member having a plurality of teeth mounted thereon, at least some of the teeth being positionable in a first cutting position during rotation of the cutting member, the first cutting position being the position of the teeth at the maximum radial distance from the drilling axis while in contact with the ground, and at least some of the teeth being positionable in a second leading position during rotation of the cutting member, the second leading position being the maximum circumferential position of the teeth about the drilling axis in the direction of rotation of the drill body; and a counter-reaction member mounted on the body and extending partially downwardly therefrom, the rotary drill bit forming a hole having a substantially cylindrical wall portion and a generally concave bottom portion extending downwardly from the lowermost portion of the cylindrical wall portion, the counter-reaction member having first and second outwardly exposed surfaces, the first surface being at least partially formed with a longitudinally disposed curvature with respect to the drilling axis so as to closely conform to the curvature of the concave bottom portion of the hole formed by the drill bit and contact the concave bottom portion, the first surface of the counter-reaction member acting as a friction pad to counteract the torque effects of rotating the drill bit about the drilling axis and the cutting member engaging the ground, the first surface of the counter-reaction member having a trailing edge, and a leading edge circumferentially opposite the trailing edge, the second surface being situated circumferentially adjacent to the first surface and being inwardly disposed with respect to the first surface, the second surface having a plurality of teeth mounted thereon and projecting therefrom for smoothing the concave bottom portion of the hole by removing ridges formed in the bottom portion by the teeth of the cutting member as the drill bit rotates.

2. A rotary drill bit as defined by claim 1, wherein the counter-reaction member is circumferentially situated on the drill bit body in relation to the cutting member such that the leading edge of the first surface thereof is at most 180° in a direction opposite the rotational direction of the drill bit body from the second leading position of the cutting member teeth.

3. A rotary drill bit as defined by claim 2, wherein the counter-reaction member is further circumferentially situated on the drill bit body in relation to the cutting member such that the trailing edge of the first surface is at most 180° in the rotational direction of the drill bit body from the first cutting position of the cutting member teeth.

4. A rotary drill bit as defined by claim 1, wherein the second surface of the counter-reaction member is inwardly angularly disposed with respect to the first surface so as to form an obtuse angle therewith.

5. A rotary drill bit as defined by claim 4, wherein the angle formed between the first and second surfaces of the counter-reaction member is between about 90° and about 175°.

6. A rotary drill bit as defined by claim 4, wherein the angle formed between the first and second surfaces of the counter-reaction member is about 150°.

7. A rotary drill bit as defined by claim 1, wherein the radial distance from the drilling axis which the teeth of the second surface project is at most equal to the radial distance from the drilling axis of the first surface.

8. A rotary drill bit as defined by claim 1, wherein the teeth of the second surface of the counter-reaction member project from the second surface at an obtuse angle with respect to the second surface and in a direction partially opposite to the direction of rotation of the drill bit.

9. A rotary drill bit as defined by claim 1, wherein the counter-reaction member further includes a plurality of studs mounted thereon, the studs being substantially flush with the first surface of the counter-reaction member, the studs being formed of a wear-resistant material.

10. A rotary drill bit as defined by claim 1, wherein the first surface of the counter-reaction member has a greater surface area than the second surface.

11. A rotary drill bit as defined by claim 1, wherein the first surface of the counter-reaction member is at least partially further formed with a circumferentially disposed curvature with respect to the drilling axis so as to closely conform to the curvature of the concave bottom portion of the hole formed by the drill bit and contact the concave bottom portion.

12. A rotary drill bit for earth boring purposes, which comprises:

a drill bit body rotatable about a drilling axis in a direction of rotation to form a hole in the ground;

a single cutting member mounted rotatably on the body and extending outwardly and downwardly therefrom, the cutting member having a plurality of teeth mounted thereon, at least some of the teeth being positionable in a first cutting position during rotation of the cutting member, the first cutting position being the position of the teeth at the maximum radial distance from the drilling axis while in contact with the ground, and at least some of the teeth being positionable in a second leading position during rotation of the cutting member, the second leading position being the maximum circumferential position of the teeth about the drilling axis in the direction of rotation of the drill body; and a counter-reaction member mounted on the body and extending partially downwardly therefrom, the rotary drill bit forming a hole having a substantially cylindrical wall portion and a generally concave bottom portion extending downwardly from the lowermost portion of the cylindrical wall portion, the counter-reaction member having first and second outwardly exposed surfaces, the first surface having a greater surface area than the second surface and being at least partially formed with a circumferentially disposed curvature and a longitudinally disposed curvature with respect to the drilling axis so as to closely conform to the curvature of the concave bottom portion of the hole formed by the drill bit and contact the concave bottom portion, the first surface of the counter-reaction member acting as a friction pad to counteract the torque effects of rotating the drill bit about the drilling axis and the cutting member engaging the ground, the first surface of the counter-reaction member having a trailing edge, and a leading edge circumferentially opposite the trailing edge, the second surface being situated circumferentially adjacent to the first surface and being inwardly angularly disposed with respect to the first surface so as to form an obtuse angle therewith, the second surface having a plurality of teeth mounted thereon and projecting therefrom for smoothing the concave bottom portion of the hole by removing ridges formed in the bottom portion by the teeth of the cutting member as the drill bit rotates;

the counter-reaction member being circumferentially situated on the drill bit body in relation to the cutting member such that the leading edge of the first surface thereof is at most 180° in a direction opposite the rotational direction of the drill bit body from the second leading position of the cutting member teeth and such that the trailing edge of the first surface is at most 180° in the rotational direction of the drill bit body from the first cutting position of the cutting member teeth.

* * * * *